US008322464B2

(12) United States Patent
Reddoch, Sr.

(10) Patent No.: US 8,322,464 B2
(45) **Date of Patent: *Dec. 4, 2012**

(54) METHOD AND APPARATUS FOR VACUUM COLLECTING AND GRAVITY DEPOSITING DRILL CUTTINGS

(76) Inventor: Jeffrey A. Reddoch, Sr., Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/700,674

(22) Filed: Feb. 4, 2010

(65) Prior Publication Data

US 2010/0212968 A1 Aug. 26, 2010

Related U.S. Application Data

(63) Continuation of application No. 11/286,475, filed on Nov. 26, 2005, now Pat. No. 7,753,126.

(51) Int. Cl.
*E21B 21/06* (2006.01)
*E21B 43/34* (2006.01)

(52) U.S. Cl. ..... 175/66; 175/206; 175/207; 166/357

(58) Field of Classification Search ..... 175/88, 175/66, 206, 207, 217; 166/357; 210/512.2, 210/787, 788, 800, 513, 538
See application file for complete search history.

(56) References Cited

U.S. PATENT DOCUMENTS

| | | | | |
|---|---|---|---|---|
| 2,931,509 | A * | 4/1960 | Batterson | 210/512.1 |
| 4,209,381 | A * | 6/1980 | Kelly, Jr. | 134/19 |
| 4,521,232 | A * | 6/1985 | Howeth | 55/324 |
| 4,526,687 | A * | 7/1985 | Nugent | 210/202 |
| 5,236,605 | A * | 8/1993 | Warncke | 210/799 |
| 5,839,521 | A * | 11/1998 | Dietzen | 175/66 |
| 5,842,529 | A * | 12/1998 | Dietzen | 175/66 |
| 5,913,372 | A * | 6/1999 | Dietzen | 175/66 |
| 6,009,959 | A * | 1/2000 | Dietzen | 175/66 |
| 6,170,580 | B1 * | 1/2001 | Reddoch | 175/66 |
| 6,213,227 | B1 * | 4/2001 | Dietzen | 175/66 |
| 6,345,672 | B1 * | 2/2002 | Dietzen | 175/66 |
| 6,391,198 | B1 * | 5/2002 | Porter et al. | 210/241 |
| 6,585,115 | B1 * | 7/2003 | Reddoch et al. | 209/3 |
| 6,640,912 | B2 * | 11/2003 | Reddoch | 175/217 |
| 6,763,605 | B2 * | 7/2004 | Reddoch | 34/58 |
| 6,910,411 | B2 * | 6/2005 | Reddoch | 100/37 |
| 6,936,092 | B2 * | 8/2005 | Seyffert et al. | 95/271 |
| 7,135,107 | B2 * | 11/2006 | Palmer | 210/104 |
| 7,380,617 | B1 * | 6/2008 | James | 175/66 |
| 7,575,072 | B2 * | 8/2009 | Reddoch, Sr. | 175/207 |
| 7,753,126 | B2 * | 7/2010 | Reddoch, Sr. | 166/357 |
| 2005/0126822 | A1 * | 6/2005 | Campbell et al. | 175/57 |
| 2006/0186056 | A1 * | 8/2006 | Ivan | 210/704 |

* cited by examiner

*Primary Examiner* — Matthew Buck
(74) *Attorney, Agent, or Firm* — Lemoine & Associates LLC

(57) ABSTRACT

A system for continuously feeding drill cuttings extracted from a cutting source into a liquid. The system has an open bottomed vacuum hood, means for positioning the open bottom of the vacuum hood in a liquid, means for creating a vacuum in the vacuum hood, a conduit for transporting the drill cuttings from the cutting source to the open bottomed vacuum hood, from which vacuum hood the drill cuttings fall, under the influence of gravity, through the open bottom of the vacuum hood and are thereby deposited into said liquid. Embodiments include means for removing and recovering residual drilling fluids extracted with the drill cuttings, reducing the size of the drill cuttings so they may be injected into a porous earth formation, relieving choke points and blockages.

15 Claims, 8 Drawing Sheets

METHOD AND APPARATUS FOR VACUUM COLLECTING AND GRAVITY DEPOSITING DRILL CUTTINGS

CROSS REFERENCE TO RELATED APPLICATIONS

This application is a continuing application of presently pending U.S. patent application Ser. No. 11/286,475 filed Nov. 26, 2005.

1. FIELD OF THE INVENTION

This invention relates generally to the collection of drill cuttings and their disposition on a drilling rig and more particularly to the improvement of such systems by utilizing vacuum and gravity in a more effective and efficient manner to move drill cutting from point to point and deposit them in a clean state for disposal and in a manner consistent with rig drilling production rates.

2. GENERAL BACKGROUND

In petroleum well drilling operations, as well as other types of wells, a hole is bored into the earth, typically by a drill bit. Drilling mud is generally circulated in and out of the well to carry away the debris from the hole being drilled. The debris, such as rock, shell etc., being returned to the surface for removal is called drill cuttings. Although the drilling fluids, or mud as it is called, also perform other tasks, due to their complex formulation, the mud is still a contaminant to the environment. Once the contaminated (mud-coated) drill cuttings and drilling fluids are circulated out of the well, the contaminated fluid and drill cuttings are pumped or otherwise conveyed to a shale shaker (many commercial types are available and well known to those skilled within the art), whereby the contaminant fluid and drill cuttings pass over a screen on the shale shakers and other fluid cleaning equipment, thus separating substantially all of the drilling fluid from the drill cuttings. However, the residual fluid left on the drill cuttings separated from the drilling fluid is still a contaminant to the environment and must be handled in an environmentally safe way. The prior art teaches and discloses a great many methods and apparatus for handling, conveying, transporting, cleaning, drying, grinding, and injecting the contaminated drill cuttings and residual fluids. Many industries completely unrelated to the petroleum drilling industry utilize vacuum hoppers, mechanical discharge hoppers and cuttings boxes for accumulating and transporting cuttings materials. Often such systems are bulky and require a great deal of storage space. In locations such as off shore drilling platforms such storage space is always scarce.

Cuttings grinding and disposal systems taught by the prior art, although much improved over the years, still require a significant complication of valves, manifolds, shakers, pumps, adjustable jets, etc., and several skid modules such as conveying and holding and circulating system skids, as well as a separate injection pump skid. The resulting systems perform very well in many cases, but require a good many highly trained operators to set up, operate, and maintain, have high operating costs, and use considerably more deck space than is now believed to be necessary.

These systems require constant monitoring and/or the use of highly complicated computer automation requiring highly trained technicians. The older, less complicated cuttings grinding and disposal systems were unable to handle the volume of large bore holes and their process rates. These older systems often lacked the secondary shale shakers, manifolds, and adjustable jets necessary to minimize the shut down times needed for cleaning out the unground cuttings from the grinding pumps. Further, manifolds/valves wore out or plugged quickly.

Poor visibility of the cuttings transfer decontamination process hampers the ability of the operator to control the various operations in time to prevent costly shutdowns. The prior art for the most part felt that it was best to completely seal the top of the grinding unit and vacuum the cuttings into the grinding tank with fluid already in it. While at first this seems like a good solution, the problem that results is that the operator cannot see the slurry that is created by grinding the cuttings in fluid. As described above, without being able to see the slurry thickening occurs and the operator is unable to determine how much fluid is required to maintain a proper mixture. Others have solved this problem by adding a second grinding tank with an open top merely for grinding the cuttings. Therefore, the primary, completely covered grinding tank becomes a transfer tank and the second tank becomes an unnecessary added grinding tank within the system. The ability to vacuum cuttings from several cuttings troughs requires several grinding transfer tanks. These tanks are cumbersome, require extra personnel to operate, take up space on the drilling rig which is hard to find, since drilling rigs have a limited amount of space available, and the operators still cannot see the conditions in these tanks which cause an operational nightmare to the operators and the drilling rig.

In reviewing the prior art developed to date if becomes clear that improvements are needed to overcome the disadvantages discussed above. For example, there needs to be a way to deliver the cuttings, unobstructed and at any volume, from the collection trough, via gravity or a continuous open discharge vacuum hopper that further allows gravity feeding of the cuttings thru a cuttings dryer to remove any residual drilling fluid or contaminates or gravity feed the cuttings directly into the grinding tank fluid. A more simplified transfer system is needed whereby there are no manifolds to complicate or wear out and no shale shakers to complicate or create unsafe and unclean working conditions.

The size of the grinding and holding tanks needs to be reduced or eliminated, thus allowing smaller skids to fit in the available space. The simplified cuttings grinding and disposal system should also use less electricity and provide a significant reduction in component parts and valves that complicate the system and tend to wear quickly. Such systems should require significantly less personnel to operate and be much simpler to automate. It is believed that it is now possible to provide a cuttings grinding and disposal system capable of being operated without stand-alone crews, instead utilizing personnel already aboard the rig who can provide limited amounts of time to the cuttings grinding and disposal systems.

3. SUMMARY OF THE INVENTION

Drill cuttings and any residual fluid contaminants still on the drill cuttings as they leave the shale shakers are deposited into a cuttings trough where they are first vacuumed, via a hollow tube positioned in the cuttings trough, into a continuous open end discharge hopper that has one end positioned into a fluid-filled tank or body of water. A vacuum is maintained upon the continuous open-ended discharge hopper by a fluid seal at one end opposite the vacuum pump. As drill cuttings and contaminant drill fluid are vacuumed from the cuttings trough to the continuous open end discharge hopper, the vacuum volume expands and air flow slows down in the discharge hopper. The heavy drill cuttings and contaminant drill fluids drop by gravity into the fluid forming the vacuum seal. Therefore, a continuous feed of drill cuttings and contaminant residual fluid being transferred by vacuum directly into a fluid tank or hopper for further treatment of the cuttings with no mechanical moving parts, other than the vacuum pump. There are no manifolds, or valves and no need to transfer or move cuttings boxes. This eliminates the bottlenecks in the process by preventing plugging and overload due to spikes in production. In some cases where the cuttings are not contaminated they may be deposited directly into the sea.

The continuous open ended hopper system disclosed herein is capable of discharging the drill cuttings and contaminant fluid into any fluid that is used for processing the drill cuttings, such as a solution for separation of contaminant drilling fluids or other such cuttings cleaning units. In some cases the cuttings may be discharged from the decontamination process by gravity feed directly into a cuttings drying unit with one end in fluid communication with the sea or sent to a cuttings grinding unit for injection back into the annulus of the well. Multiple open-ended discharge hoppers are placed within the grinding tank to allow for vacuuming from different cuttings troughs, heretofore not possible due to hose plugging problems inherent to cuttings vacuum systems.

Cuttings slurry visibility is now possible via the open top slurry tank made possible by the continuous vacuum hopper which allows the cuttings slurry to be discharged directly into the open cuttings grinding tank. As the cuttings grind, they turn the cuttings into clay, which takes up any free fluid in the tank rapidly. The slurry often thickens and plugs the grinding unit, thus visibility is essential for the operator to dilute the slurry in time to prevent back up of the system causing expensing drilling rig downtime.

Additional embodiments disclosed herein show how the continuous open-ended discharge vacuum hopper may be used in combination with other cuttings processing equipment, for example the vacuum hopper may be connected to a cuttings dryer system. The vacuum hopper may also be connected fluidly to a cuttings dryer whereby the continuous open-ended discharge vacuum hopper discharges directly into the cuttings dryer, the cuttings dryer is sealed to allow no openings to allow for a loss of vacuum efficiency, and the discharge end of the cuttings dryer is fluidly connected to the sea, allowing the cuttings to be discharged directly into the sea. This completely sealed system eliminates many places that contaminant mud can splash onto the rig or into the sea.

Still other embodiments depict methods for utilizing an open-end vacuum hopper for discharging cuttings directly into the sea. This method utilizes a cuttings cleaning tank sitting in the sea using sea water to clean the cuttings, with contaminant mud floating to the top and being skimmed off in the cuttings cleaning tank.

Other embodiments disclose the cuttings being discharged from an open-end vacuum hood directly into a grinding tank where the cuttings are resized for further processing and disposal. In yet other cases the cuttings are discharged into a cuttings dryer that is fluidly sealed with a cuttings collection tank. Such tanks may include a hatch cover to allow for removing the dried cuttings at a later date. Such tanks may have a fluidized bed or other type of transfer unit located at the bottom for removal.

It is therefore an object of the invention to provide a method and apparatus for vacuuming heavy solids into a discharge hopper having one end submerged within a fluid for further processing or transportation of the material.

4. BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

5. DETAILED DESCRIPTION OF THE PREFERRED EMBODIMENT

Figure 1:
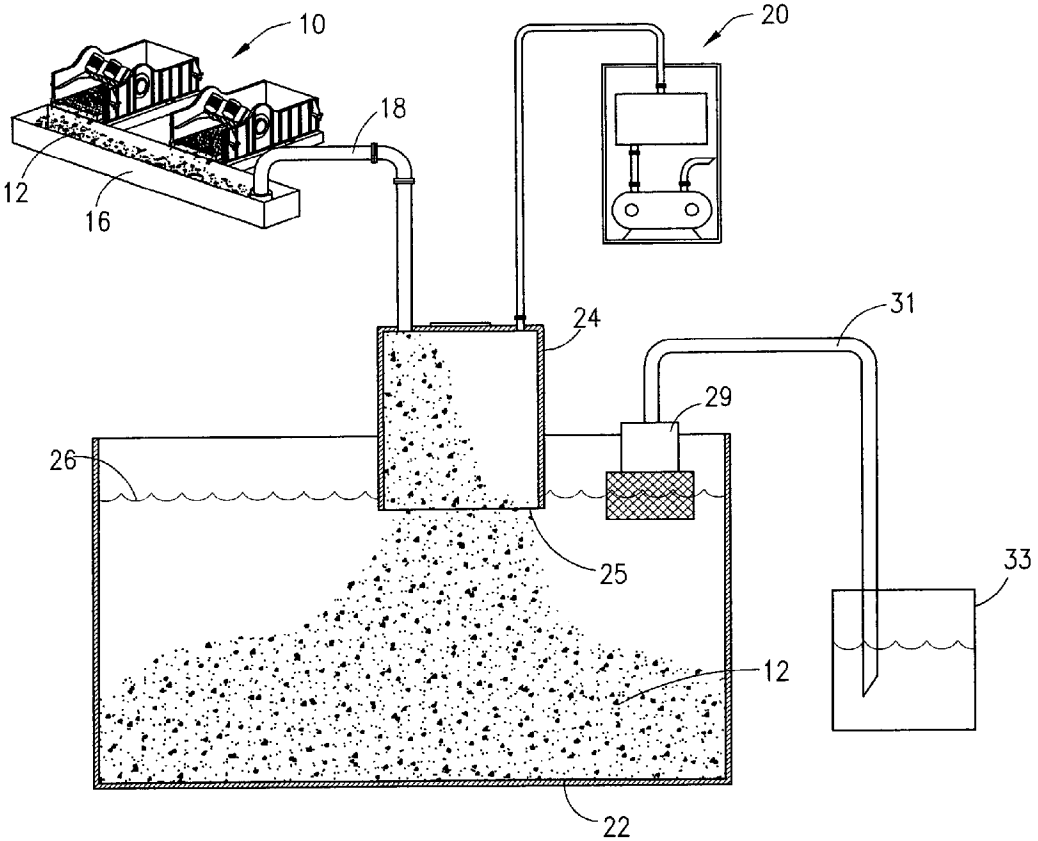
FIG. 1 is a pictorial view of the cuttings vacuum collection system.

As seen In FIG. 1, a group of shale shakers 10, typically composed of sets of coarse and fine sifting screens generally separates the drill cuttings 12 from the majority of the drilling fluids used to circulate the cuttings from the well before being circulated back in the well bore. The heavy drill cuttings 12 leaving the shakers 10 and any remaining residual contaminant drilling fluids 14 (present but not detectable here) are gravity fed into a cuttings collection trough 16. A tube 18 is positioned at the lower end of the cuttings trough 16 in a manner whereby the feed or suction tube 18 is submerged and/or in general contact with the cuttings 12 being gravity fed thereto. The opposite end of the tube 18 is connected to an open-end vacuum hood or chamber 25. A vacuum pump and filter system 20 is also connected to the vacuum hood 25.

It has been found that by utilizing an open-ended vacuum chamber such as hood 24 in a manner whereby the hood's open end 25 is partially submerged in a fluid 26 as shown in FIG. 1 a generally positive vacuum may be maintained at least periodically without sealing the cuttings container 22, thus leaving an open top, in which case the heavy cuttings 12 are more easily collected and deposited within the cuttings container 22 without buildup or choking. Drill cuttings 12 being moved from cuttings sources such as the shaker trough 16 or other cuttings tanks generally provide sufficient vacuum within the tube 18, for relatively short periods of time, to move the cuttings through the tube 18 before being dropped by gravity within the chamber or hood 24. The interruptions in the vacuum pressure, due to incomplete suction seal, prevents the fluid 26, surrounding the hood's open end 25, from being drawn into the vacuum system 20.

Figure 2:
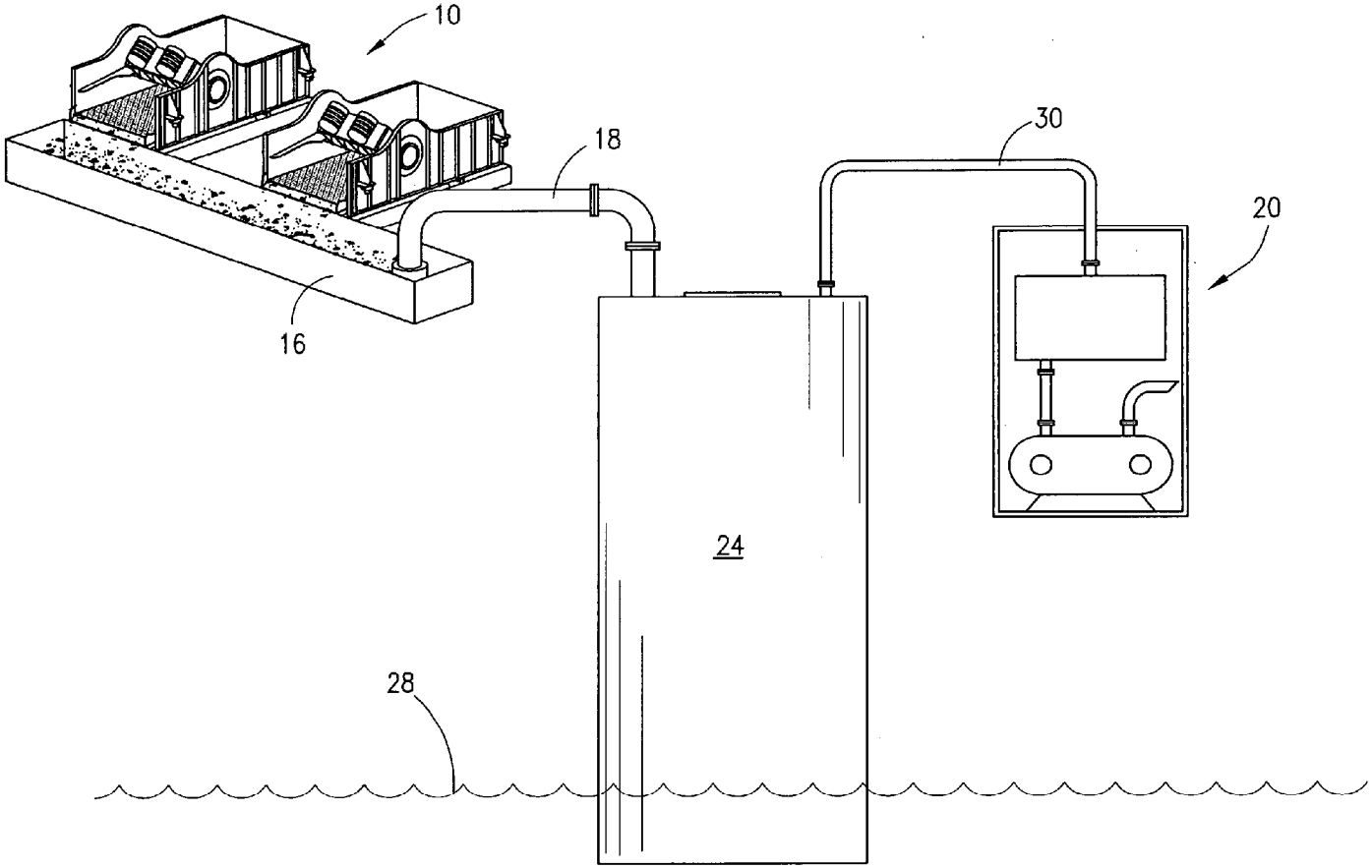
FIG. 2 is a pictorial view of a variation of the cuttings vacuum collection system shown in FIG. 1.

Using the above principle the open end chamber or hood 24 seen in FIG. 1 may be extended over the side of an offshore well platform to below the surface of the sea 28, as seen in FIG. 2, for cutting discharge directly on to the sea. In this manner a vacuum is maintained within the open-ended hood 24 by the vacuum system 20 connected by hose or piping 30 to the hood 24 to which the drill cuttings and their contaminant residual fluids which are fluidly connected via suction hose 18. In this manner the cuttings 12 being drawn from the cuttings trough 16 flow freely to the sea as a result of there being no opening to atmosphere, thus forming periodic vacuum seals. Drill cuttings 12 and contaminant fluids 14 are gravity fed into the fluid 26 in cuttings tank 22, as seen in FIG. 1, or to the sea 28, as seen in FIG. 2, by generally the same method.

Excess fluids 26 and residual drilling fluids 14 may drawn from the cutting tank 22, as shown in FIG. 1, by a surface skimmer 29 and fed through tubing 31 to a receiving tank 33 or recycled back to the cutting tank 22 as needed to maintain sufficient fluid within the tank to cover the open end 25 of the vacuum chamber or hood 24.

Figure 3:
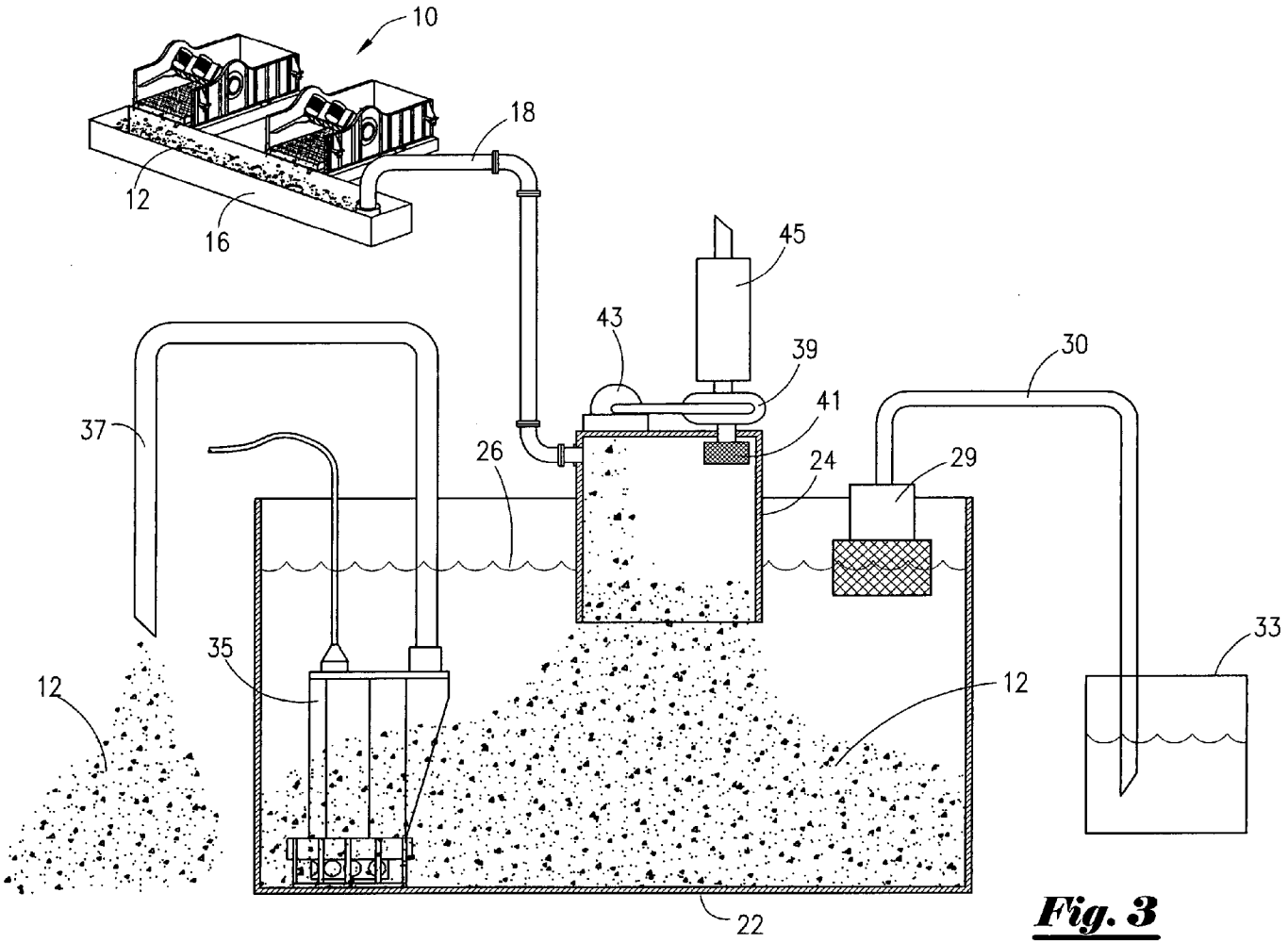
FIG. 3 is a pictorial view of the cuttings vacuum collection system shown in FIG. 1 with alternative vacuum pump location.

Looking now at FIG. 3, we see that an electrical driven submersible grinder/pump 35 may be installed within the tank 22 for further sizing the cuttings 12 prior to transfer to other tanks, treatment systems, and/or disposition to the environment via transfer tube 37. In some cases it may be advantageous to locate the vacuum system integral with the vacuum hood 24, as shown in FIG. 3. In this arrangement the suction line of the vacuum pump 39 extends inside the hood 24 and is fitted with a wet/dry filter 41, The vacuum pump is driven by a motor 43 and the exhaust port is fitted with muffler 45 to reduce noise. The arrangement eliminates the need for a fluids collection tank in the vacuum system 20 as generally provided.

Figure 4:
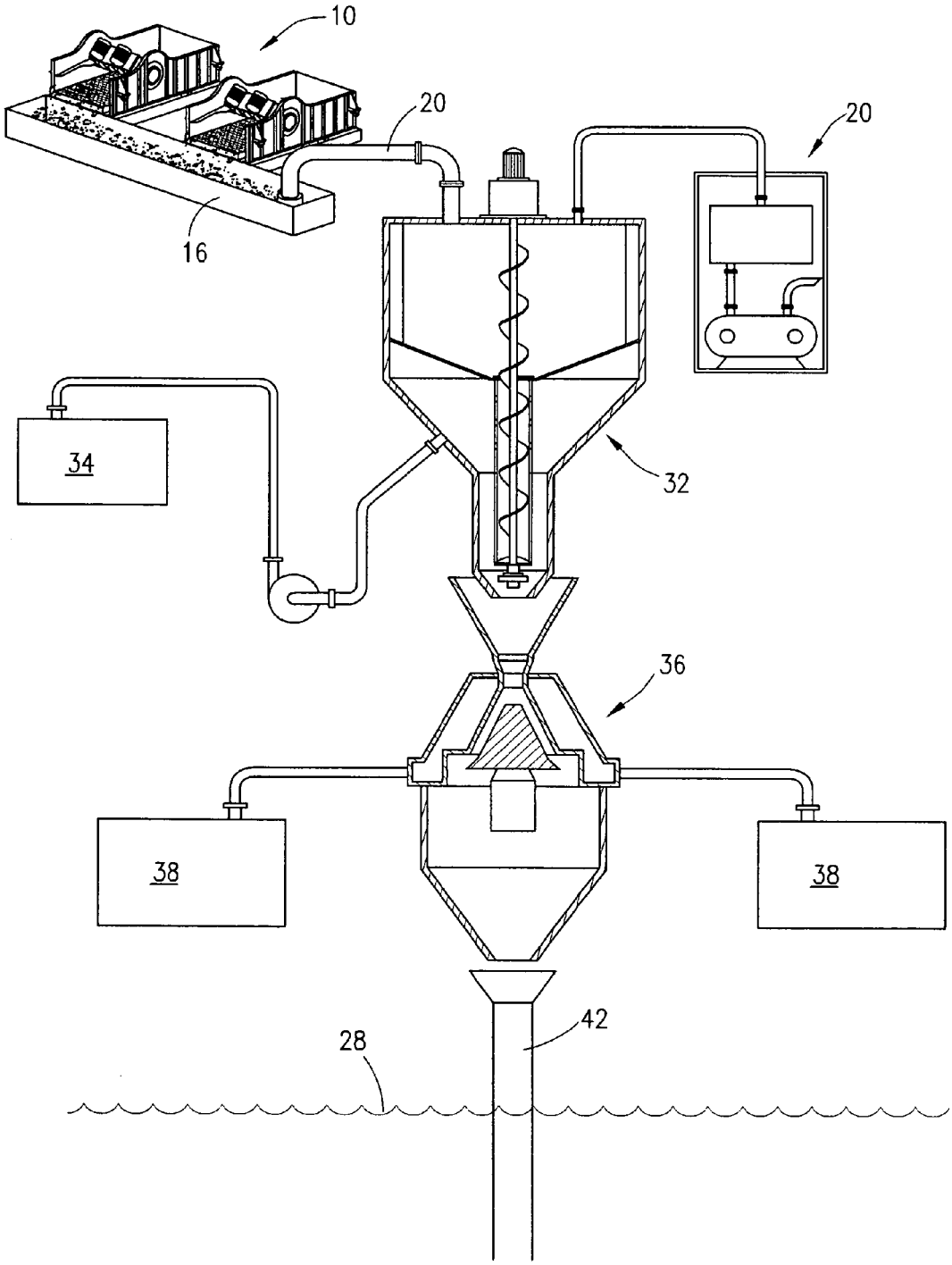
FIG. 4 is a pictorial view of an arrangement using prior art elements to collect, defluidize drill cuttings by a vacuum method and discharge them to the sea.

Looking now at FIG. 4, we see that using the known prior art drill cuttings defluidizing units such as those disclosed by Reddoch, U.S. Pat. Nos. 6,170,580 and 6,763,605, or other similar cuttings transport, handling, processing, or treating systems that utilize a carrier fluid, a cuttings vacuum system comprised of a vacuum pump and filter unit 20, a cutting compaction unit 32 having fluid recovery system 34, may be used to discharge semi-dry cuttings to a centrifugal fluid separation unit 36 for further fluid recovery in tanks 38 prior to discharging the cutting to the sea 28.

Currently conveyers moving the cuttings from unit to unit add significant restrictions to the process. However, an arrangement, as shown in FIG. 4, utilizing gravity feed from unit to unit and ultimately collected by a shunt tube 42 extending into the sea still presents restrictions and choke points for the cuttings and relies on the through-put ability of the compression system 32 to speedily move the cutting at a pace equal to cutting production.

Figure 5:
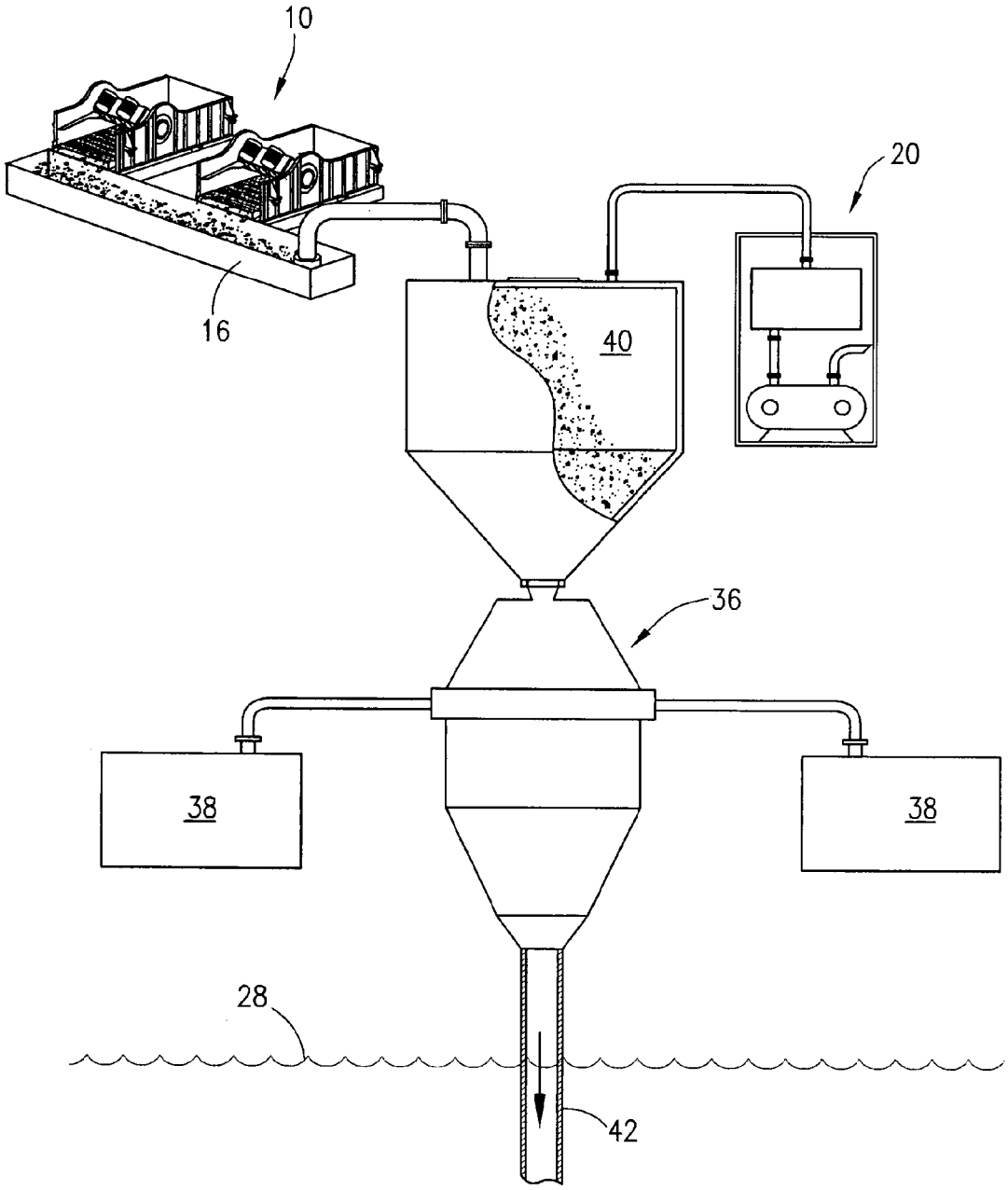
FIG. 5 is a pictorial view of an arrangement utilizing the cuttings vacuum system disclosed herein to defluidize and discharge cuttings to the sea.

It can be seen In FIG. 5 that by removing the compression components in the cutting compaction unit 32 we are left with a vacuum hopper 40. Thus, by directly connecting the discharge of the vacuum hopper 40 to the centrifugal drilling fluid separation unit 36 and directly connecting to shunt tube 42 extending to below the sea surface 28, a vacuum is maintained through the system and the cuttings are allowed to free fall directly to the sea with a minimum of residence time within the defluidizer 36 to remove the residual fluids 14.

Figure 6:
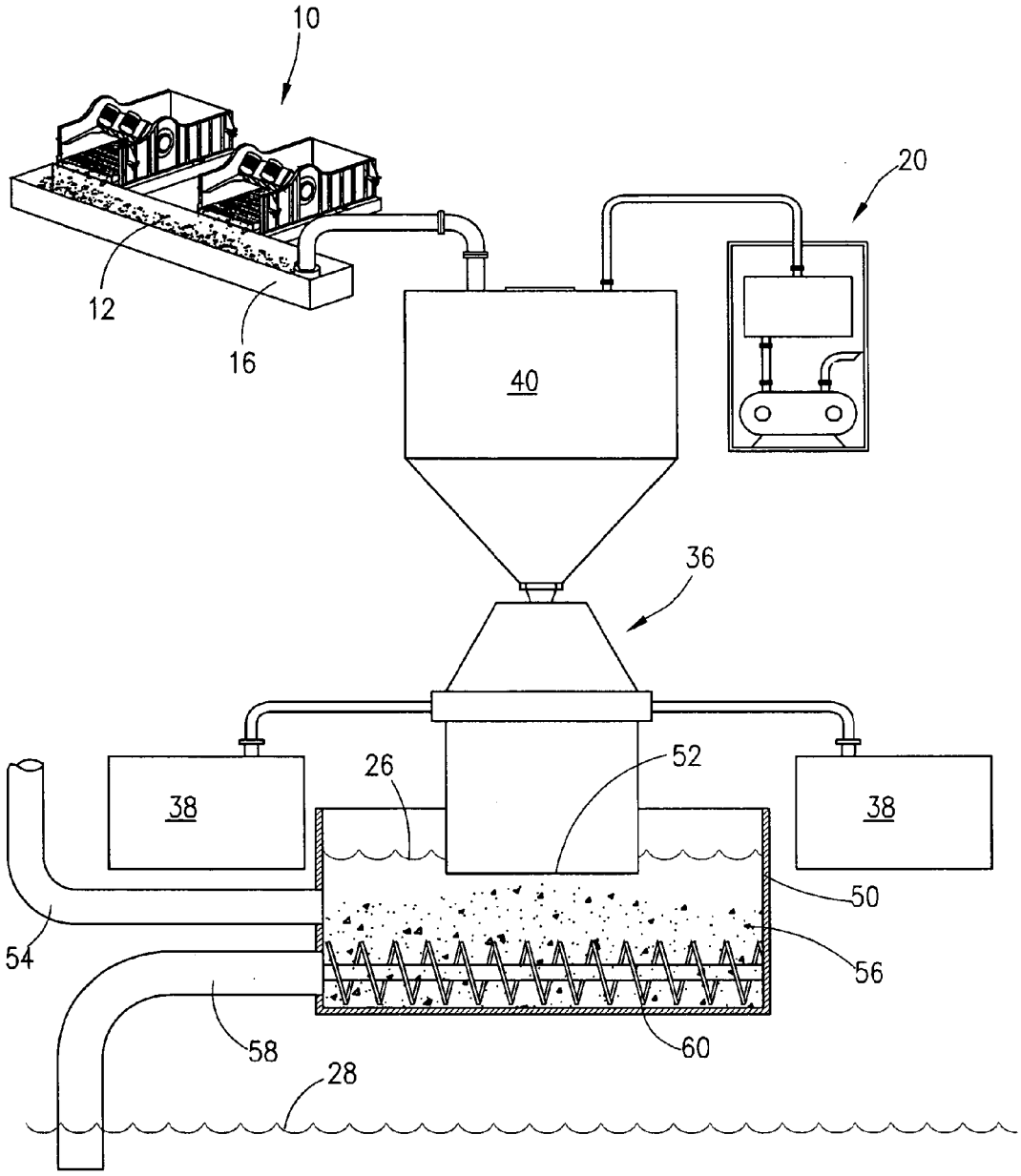
FIG. 6 is a pictorial view of an alternative cuttings collection system and defluidization with wash down prior to force feed discharge to alternative locations including the sea.

Other embodiments may utilize the vacuum hood principle such as may be seen in FIG. 6. In the system shown in FIG. 5 it is utilized with direct discharge from the defluidizer 36 into an open tank 50 and the open base 52 of the defluidizer 36 is maintained below the surface of a fluid 26, such as sea water. The seawater may be supplied from the salt water pumps onboard the drilling rig via tubing 54. In this arrangement the seawater helps clean the cuttings 56 which may be agitated and mechanically conveyed via a conveyor 60 or agitator pumps to a discharge tube 58 for discharge into the sea 28 or to other processing and disposal system. Fluid levels within the tank 50 are constantly monitored and automatically maintained. Skimmers 29 may also be utilized within the tank 50 to remove residual drilling fluids 14.

Figure 7:
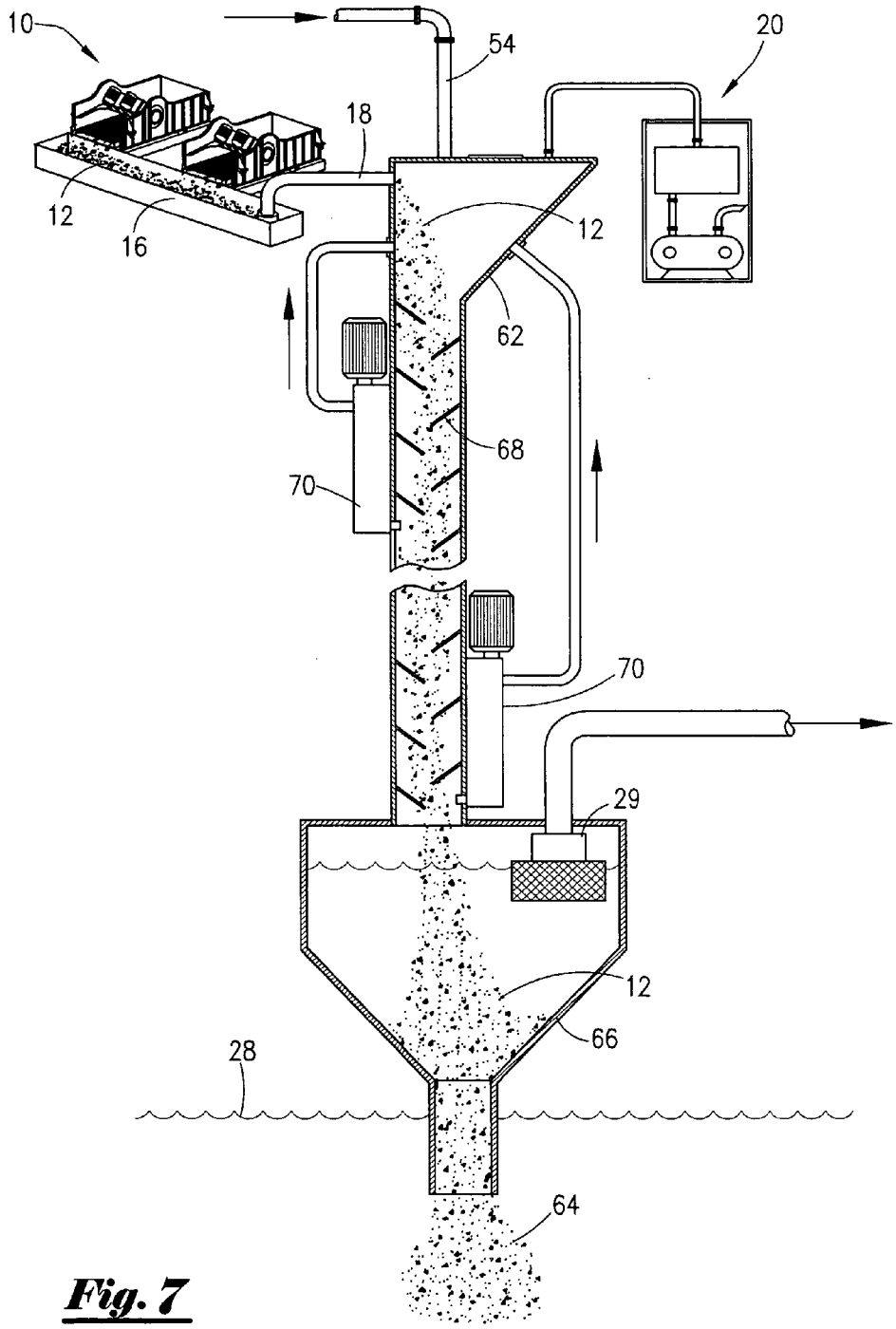
FIG. 7 is a pictorial view of a cutting collection system utilizing an enclosed baffled shunts tube and pump out system.

Turning now to FIG. 7, we see that an extended and modified shunt tube 62 may be utilized to dispose of the drill cuttings by gravity feed to the sea or to any fluid-filled container. In this arrangement we see the shunt tube 62 being utilized as a vacuum chamber with the cuttings introduced thereto through feed or suction line 18. A vacuum is maintained by vacuum system 20 as a result of the lower end 64 of the chamber 66 being below the surface of the sea or other such fluid levels. The shunt tube 62 is shown connected to a fluidized chamber 66 in which the fluid levels are maintained with seawater being supplied to the top of the shunt tube 62 through tube 54. Baffles 68 are added to the inside of the shunt tube 62 to increase residence time of the cuttings cascading down through the shunt tube 62, thereby increasing washing efficiency. Cuttings flowing through the fluidized chamber 66 are discharged at a rate somewhat slower than the inflow, thus allowing further residency time in the wash fluids and allowing any residual drilling fluids to be skimmed off via the skimmer 29 to a recovery tank 33. Mud pumps 70 located along the length of the shunt tube 62 may be used as needed to remove cuttings blocks or dams that may occur periodically within the shunt 62 and inject the cuttings back into the upper portion of the tube 62.

Figure 8:
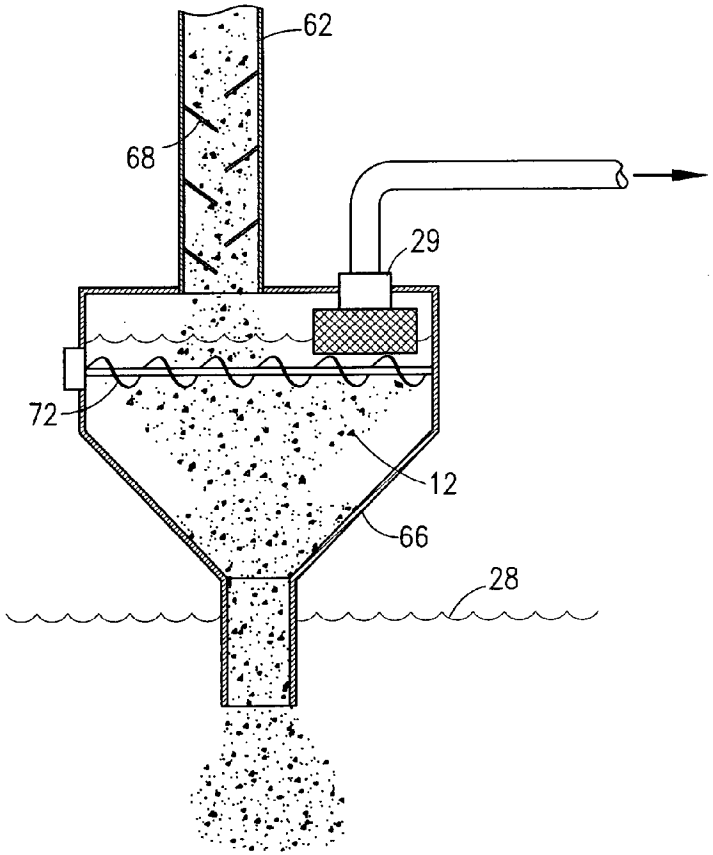
FIG. 8 is a partial view of the shunt tube system shown in FIG. 7 with mixer; and, FIG. 9 is a partial view of the shunt tube shown in FIG. 8 with a grinder.

Agitators 72 located within the fluid chamber 66 may be used, as shown in FIG. 8, to further improve the wash cycle and release residual drilling fluids 14 from the cuttings 12.

Figure 9:
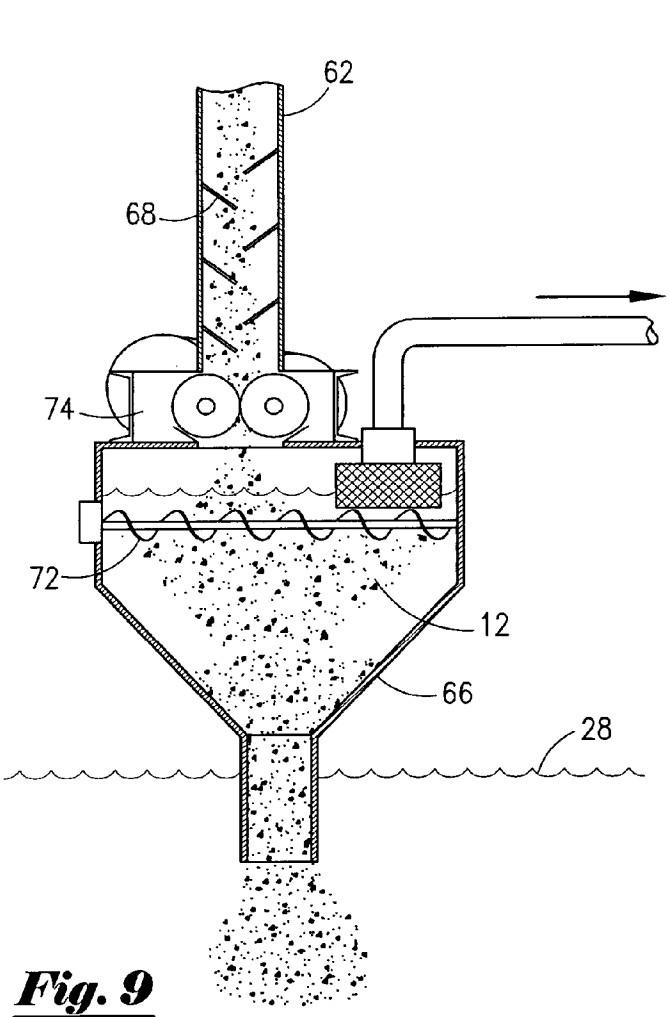

Sizing and/or pulverization of the cuttings may also be accomplished by locating a grinding mill 74 adjacent to the fluid chamber 66, as shown in FIG. 9, for sizing the cuttings prior to discharge.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A vacuum system for transferring drill cuttings, and residual drilling fluid thereon, discharged from shale shakers of a drilling rig into a body of liquid, characterized in that the system comprises:

a suction tube communicative between said shale shakers and a chamber, the chamber having an open bottom which extends into said body of liquid; and, a vacuum pump connected to the chamber, the vacuum pump generating a vacuum within the chamber and operable with the suction tube to move the drill cuttings and residual drilling fluid from said shale shakers through the suction tube and into said chamber, from which chamber said drill cuttings and drilling fluid thereon fall by gravity into the body of liquid.

2. The vacuum system according to claim 1, wherein said drill cuttings release residual drilling fluids into the body of liquid.

3. The vacuum system according to claim 2, further comprising skimmer for recovering drilling fluid from the surface of said body of liquid.

4. The vacuum system according to claim 1, wherein said body of liquid is contained within a container having an open top.

5. The vacuum system according to claim 4, wherein said container further comprises at least one submersible grinding pump.

6. The vacuum system according to claim 1, wherein said vacuum system further comprises a vacuum-sealed defluidization and drilling fluid recovery means located between said chamber and said body of liquid.

7. The vacuum system according to claim 4, wherein said container comprises an agitator and a discharge tube.

8. The vacuum system according to claim 1, wherein said chamber is a shunt tube comprising:

a) a connection to a source of sea water;

b) a plurality of baffles located within said shunt tube, and, c) a fluidization container connected to said shunt tube having a discharge port.

9. A process for collecting drill cuttings, and residual drilling fluid thereon, discharged from shale shakers of a drilling rig characterized in that the process comprises the steps of:

providing a suction tube communicative between said shale shakers and a chamber, the chamber having an open bottom which extends into a body of liquid; and, using a vacuum pump connected to the chamber to generate a vacuum within the chamber to move the drill cuttings from the shale shakers through the suction tube and into said chamber, from which chamber said drill cuttings and drilling fluid thereon fall by gravity into the body of liquid.

10. The process according to claim 9, further comprising the step of placing said body of liquid within a container having an open top.

11. The process according to claim 10, further comprising the step of skimming drilling fluids from the surface of the body of liquid.

12. The process according to claim 9, further comprising the step of submersing, grinding and circulating the drill cuttings within said container.

13. The process according to claim 9, further comprising the step of using centrifugal fluid separation to separate the residual drilling fluids from the drill cuttings prior to discharge into the body of liquid.

14. The process according to claim 9, further comprising the step of agitating the body of liquid and urging the drill cuttings in said body of liquid towards a discharge port in container.

15. The process according to claim 9, further comprising the step of reducing the size of said drill cuttings in said body of liquid prior to discharge from said container.

* * * * *